US011298733B2

(12) United States Patent
Sano

(10) Patent No.: US 11,298,733 B2
(45) Date of Patent: Apr. 12, 2022

(54) METHOD FOR CALCULATING PLATE THICKNESS SCHEDULE FOR TANDEM ROLLING MACHINE AND ROLLING PLANT

(71) Applicant: Toshiba Mitsubishi-Electric Industrial Systems Corporation, Tokyo (JP)

(72) Inventor: Mitsuhiko Sano, Tokyo (JP)

(73) Assignee: TOSHIBA MITSUBISHI-ELECTRIC INDUSTRIAL SYSTEMS CORPORATION, Tokyo (JP)

( * ) Notice: Subject to any disclaimer, the term of this patent is extended or adjusted under 35 U.S.C. 154(b) by 226 days.

(21) Appl. No.: 16/652,417

(22) PCT Filed: Oct. 30, 2019

(86) PCT No.: PCT/JP2019/042506

§ 371 (c)(1),
(2) Date: Mar. 31, 2020

(87) PCT Pub. No.: WO2021/084636

PCT Pub. Date: May 6, 2021

(65) Prior Publication Data

US 2021/0402449 A1 Dec. 30, 2021

(51) Int. Cl.
*B21B 37/16* (2006.01)

(52) U.S. Cl.
CPC ..... *B21B 37/16* (2013.01)

(58) Field of Classification Search
CPC ..... B21B 37/16; B21B 37/165; B21B 37/18; B21B 37/20; B21B 37/24; B21B 38/04; B21B 2261/04; G06F 17/16
USPC ..... 700/155; 72/9.2, 11.8; 703/2, 6
See application file for complete search history.

(56) References Cited

U.S. PATENT DOCUMENTS 4,292,825 A * 10/1981 Morooka ..... B21B 37/52 72/10.1
5,609,053 A * 3/1997 Ferreira ..... B21B 37/16 72/11.8
6,240,756 B1 * 6/2001 Tsugeno ..... B21B 37/16 72/10.3

(Continued)

FOREIGN PATENT DOCUMENTS

JP H0734929 B2 * 4/1995 ..... B21B 37/16
JP H07100516 A * 4/1995 ..... B21B 37/18

(Continued)

*Primary Examiner* — Adam J Eiseman
*Assistant Examiner* — Matthew Stephens
(74) *Attorney, Agent, or Firm* — Xsensus LLP

(57) ABSTRACT

A plate thickness schedule calculation method includes a plurality of steps. One step acquires a rolling model expression including a roll force model or a motor power model. Another step determines whether or not a parameter restriction has occurred that restricts at least one parameter of roll force, motor power and a reduction rate in each rolling stand. Further another step is to select a first derived function when no parameter restriction occurs and to select a second derived function when the parameter restriction has occurred in accordance with a result of the determination for each rolling stand. Still another step modifies each delivery side plate thickness in each rolling stand using a matrix including the one derived function selected from the first derived function and the second derived function in accordance with the result of the determination.

6 Claims, 4 Drawing Sheets

(56) References Cited

U.S. PATENT DOCUMENTS

| | | | | |
|---|---|---|---|---|
| 2007/0068210 | A1* | 3/2007 | Pittner | B21B 37/165<br>72/10.1 |
| 2010/0192654 | A1* | 8/2010 | Tachibana | B21B 37/16<br>72/12.7 |

FOREIGN PATENT DOCUMENTS

| | | | | |
|---|---|---|---|---|
| JP | 2510090 | B2 * | 6/1996 | B21B 37/16 |
| JP | 2000-167612 | A | 6/2000 | |
| JP | 2000167612 | A * | 6/2000 | B21B 37/16 |
| JP | 4959646 | B2 * | 6/2012 | B21B 37/50 |
| KR | 950009912 | B1 * | 9/1995 | B21B 37/16 |

* cited by examiner

FIG. 2

$MX_1$ $$J = \begin{bmatrix} \frac{\partial g_1}{\partial h_1} & & & & \frac{\partial g_1}{\partial V_1} & & & \frac{\partial g_1}{\partial U} \\ \frac{\partial g_2}{\partial h_1} & \frac{\partial g_2}{\partial h_2} & & & & \frac{\partial g_2}{\partial V_2} & & \frac{\partial g_2}{\partial U} \\ & \frac{\partial g_3}{\partial h_2} & \frac{\partial g_3}{\partial h_3} & & & & \frac{\partial g_3}{\partial V_3} & \frac{\partial g_3}{\partial U} \\ & & \frac{\partial g_4}{\partial h_3} & \frac{\partial g_4}{\partial h_4} & & & \frac{\partial g_4}{\partial V_4} & \frac{\partial g_4}{\partial U} \\ & & & \frac{\partial g_5}{\partial h_4} & & & & \frac{\partial g_5}{\partial U} \\ \frac{\partial g_6}{\partial h_1} & & & & \frac{\partial g_6}{\partial V_1} & & & \frac{\partial g_6}{\partial u} \\ \frac{\partial g_7}{\partial h_1} & \frac{\partial g_7}{\partial h_2} & & & & \frac{\partial g_7}{\partial V_2} & & \frac{\partial g_7}{\partial u} \\ & \frac{\partial g_8}{\partial h_2} & \frac{\partial g_8}{\partial h_3} & & & & \frac{\partial g_8}{\partial V_3} & \frac{\partial g_8}{\partial u} \\ & & \frac{\partial g_9}{\partial h_3} & \frac{\partial g_9}{\partial h_4} & & & \frac{\partial g_9}{\partial V_4} & \frac{\partial g_9}{\partial u} \\ & & & \frac{\partial g_{10}}{\partial h_4} & & & & \frac{\partial g_{10}}{\partial u} \end{bmatrix}$$

$R_{i+N}$ $C_{10}$ $MX_2$

METHOD FOR CALCULATING PLATE THICKNESS SCHEDULE FOR TANDEM ROLLING MACHINE AND ROLLING PLANT

CROSS-REFERENCE TO RELATED APPLICATION

The present application is based on PCT filing PCT/JP2019/042506, filed Oct. 30, 2019, the entire contents of which are incorporated herein by reference.

TECHNICAL FIELD

The present application relates to a method for calculating a plate thickness schedule for a tandem rolling mill and a rolling plant.

BACKGROUND ART

Conventionally, as described in, for example, JP2000-167612, a calculation method for automatically correcting a plate thickness schedule is known. The above prior art automatically corrects the plate thickness schedule by reducing a force ratio target value in a target rolling stand when each of a reduction rate, roll force, rolling torque and the like exceeds a limit.

CITATION LIST

Patent Literature

[PTL1] JP2000-167612

SUMMARY

Technical Problem

The present inventor has found a problem that performance of a conventional plate thickness schedule calculation method is deteriorated in accordance with the number of rolling stands to be corrected or a correction amount thereof. Specifically, the above conventional plate thickness schedule correction method may function well in some cases, and may also cause calculation thereof to be stagnant in other cases. The method can works well when a small number of rolling stands requires plate thickness schedule correction or when a plate thickness schedule correction amount is small.

On the other hand, calculation becomes stagnant in a case where a large number of stands, for example a majority therein, requires plate thickness schedule correction, or in a case where the plate thickness schedule correction amount is large to some extent. Specifically, the stagnation of calculation includes high calculation load or a difficulty of converging repeated calculation, for example. Hence, the prior art has still left room for improvement.

The present application has been made to solve the problems as described above, and an object thereof is to provide an improved method for calculating a plate thickness schedule and a rolling plant so as to suppress stagnation of plate thickness schedule calculation.

Solution to Problem

A plate thickness schedule calculation method for a tandem rolling machine according to the present application includes a plurality of steps described below. One step acquires a rolling model formula including a first value which is one of a roll force ratio and a motor power ratio in each of a plurality of rolling stands. Another step performs determination whether or not parameter restriction to limit a second value has occurred when the second value is at least one value of roll force, motor power, and a reduction rate in each of the rolling stands. Further another step is to select one derived function from a first derived function and a second derived function to use the one derived function as a derived function of an evaluation function, the evaluation function evaluates an error based on the first value, the first derived function is a function configured to satisfy a ratio specified by the first value, the second derived function is defined in advance so that the second value is set in accordance with the parameter restriction, and the further another step selects each derived function for each rolling stand in accordance with a result of the determination so that the first derived function is selected when the parameter restriction does not occur and the second derived function is selected when the parameter restriction occurs. Still another step modifies each delivery side plate thickness in each rolling stand using a matrix including the one derived function selected from the first derived function and the second derived function in accordance with the result of the determination.

A rolling plant according to the present application includes: a plurality of rolling stands; a roll gap control device provided in each rolling stand of the plurality of rolling stands; an electric motor for rotating rolls in each rolling stand, and a process computer configured to calculate a plate thickness schedule of each rolling stand based on a first value which is one of a roll force ratio of the roll gap control device and a motor power ratio of the electric motor.

In the rolling plant, the process computer is configured to execute each processing described below. One processing acquires a rolling model formula including the first value for each rolling stand. Another processing determines whether or not a second value is restricted by parameter restriction, and the second value is at least one value of roll force, motor power, and a reduction rate in each of the rolling stands. Further another processing is to select one derived function from a first derived function and a second derived function to use the one derived function as a derived function of an evaluation function, the evaluation function evaluate an error based on the first value, the first derived function is a function configured to satisfy a ratio of the first value, the second derived function is defined in advance so that the second value is set in accordance with the parameter restriction, and each derived function for each rolling stand is selected in accordance with a result of the determination so that the first derived function is selected when the parameter restriction does not occur and the second derived function is selected when the parameter restriction occurs. Still another processing modifies each delivery side plate thickness in each rolling stand using a matrix including the one derived function selected from the first derived function and the second derived function in accordance with the result of the determination.

The plate thickness schedule calculation method described above and the process computer may be modified to change order of the steps or order of processing, except when the order relationship thereof is clearly defined.

Advantageous Effects

According to the present application, a novel technique is used to change a function for calculation depending on whether or not limitation of rolling parameters has occurred.

This makes it possible to appropriately correct calculation contents, and thus stagnation of plate thickness schedule calculation can be suppressed.

BRIEF DESCRIPTION OF DRAWINGS

FIG. 2 is a diagram for explaining a configuration of a Jacobian matrix used in a thickness schedule calculation method according to the embodiment;

DESCRIPTION OF EMBODIMENTS

[System Configuration of the Embodiment]

Figure 1:
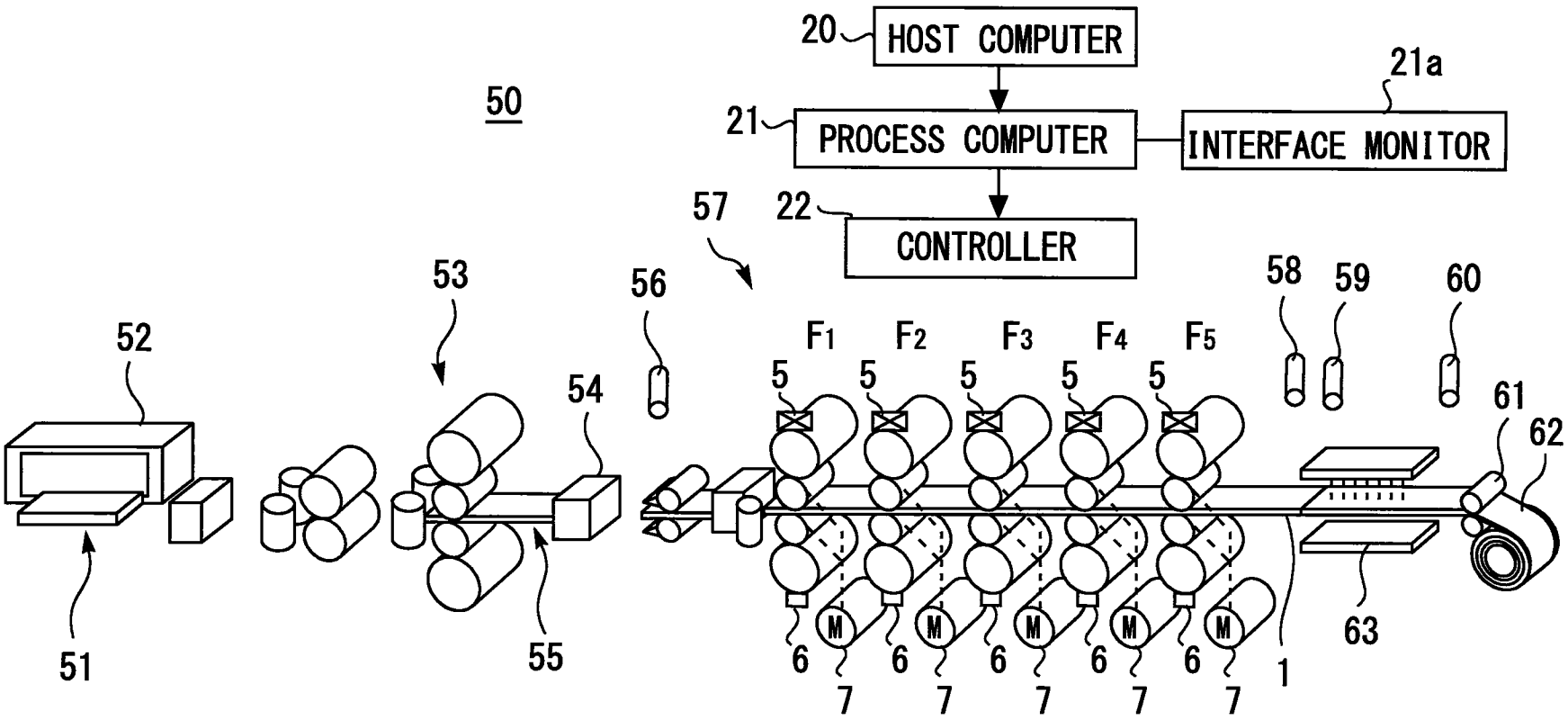
FIG. 1 is a schematic diagram illustrating a configuration of a rolling plant according to the embodiment.

FIG. 1 is a schematic diagram illustrating a configuration of a rolling plant 50 according to the embodiment. The rolling plant 50 consists of one or more rolling stands. The rolling plant 50 rolls steel or other metallic material to make them a plate shape in hot or cold temperature.

The rolling plant 50 includes a heating furnace 52, a roughing rolling mill 53 having one rolling stand, a bar heater 54, a finishing rolling mill 57, a water cooling device 63, a winder 61, and a roller table (not shown) for conveying material-to-be-rolled 1 therebetween.

The roughing rolling mill 53 includes a roll gap control device (not shown) and a roll rotation motor (not shown). The finishing rolling mill 57 includes a plurality of rolling stands $F_1$ to $F_5$. Each rolling stand $F_1$ to $F_5$ includes a plurality of rolls, a roll gap control device 5, and an electric motor 7 to rotate the rolls. The number of stands of the finishing rolling mill 57 is not limited, for example, five to seven rolling stands may be provided, but that in the embodiment is five as an example.

In the following description, the roll gap control device and the roll rotation motor in each rolling mill described above may be referred to as "equipment" of the rolling plant 50, for convenience. The equipment may include various components other than the roll gap control device and the electric motor depending on specific structure of the rolling mill. These equipment includes an actuator (not shown).

Material-to-be-rolled 51 is material rolled in the rolling plant 50. The material-to-be-rolled 51 is heated to raise its temperature in the heating furnace 52, and thereafter is extracted on a roller table (not shown) in the rolling line. The material-to-be-rolled 51 at this stage is a steel piece, for example.

When the material-to-be-rolled 51 reaches the roughing rolling mill 53, the material-to-be-rolled 51 is repeatedly rolled while changing the rolling direction to become material-to-be-rolled 55. The material-to-be-rolled 55 is a bar having a thickness of, for example, several tens of millimeters.

The material-to-be-rolled 55 is then sequentially bitten into the rolling stands $F_1$ to $F_5$. The material-to-be-rolled 55 is rolled in one direction to have a desired plate thickness. Material-to-be-rolled 1 at this stage is also referred to as a strip.

Thereafter, the material-to-be-rolled 1 is cooled by the water cooling device 63. The material-to-be-rolled 1 after cooled is wound by the winder 61. As a result, a coil product 62 is obtained.

Various sensors are installed at main places in the rolling plant 50. The main places in the rolling plant 50 are, for example, a delivery side of the heating furnace 52, a delivery side of the roughing rolling mill 53, a delivery side of the finishing rolling mill 57, an entry side of the winder 61, and the like. Various sensors may also be provided between the rolling stands $F_1$ to $F_5$ of the finishing rolling mill 57.

Various sensors include an inlet pyrometer 56 of the finishing rolling mill 57, a plate thickness gauge 58 for measuring a plate thickness and a plate width, a delivery side pyrometer 59 of the finishing rolling mill 57, and a roll force sensor 6. Various sensors are sequentially measuring states of the material-to-be-rolled 1 and each equipment.

The rolling plant 50 is operated by a control system using computers. The computers include a host computer 20 and a process computer 21 connected to each other via a network. The process computer 21 is connected to an interface monitor 21*a* via a network.

The host computer 20 transmits commands of rolling instruction to the process computer 21 based on a production plan which is planned in advance. The rolling instruction includes, for example, target sizes of each material-to-be-rolled, a target temperature and the like. The target sizes include, for example, a thickness, a width, an amount of plate crown and the like. The target temperature includes, for example, a delivery side temperature of the finishing rolling mill 57, an entry side temperature of the winder 61 and the like.

When the material-to-be-rolled 51 is extracted from the heating furnace 52, the process computer 21 calculates setting values for each piece of equipment of the rolling plant 50 in accordance with the rolling instruction from the host computer 20. The process computer 21 outputs the calculated setting values to a controller 22. The setting values include a roll gap control position of the roll gap control device 5, a roll rotation speed, bending force, a work roll shift amount and the like.

When each of the material-to-be-rolled 51, the material-to-be-rolled 55, and the material-to-be-rolled 1 is conveyed to a predetermined position in front of each piece of equipment, the controller 22 operates each actuator (not shown) of each piece of equipment of the rolling plant 50 based on the setting values. When rolling process is started, the controller 22 sequentially operates each actuator based on sensor measurement values from a radiation thermometer, an X-ray plate thickness meter, a load cell and the like so that each of the target size and the target temperature of the material-to-be-rolled 1 matches the rolling instruction.

Figure 4:
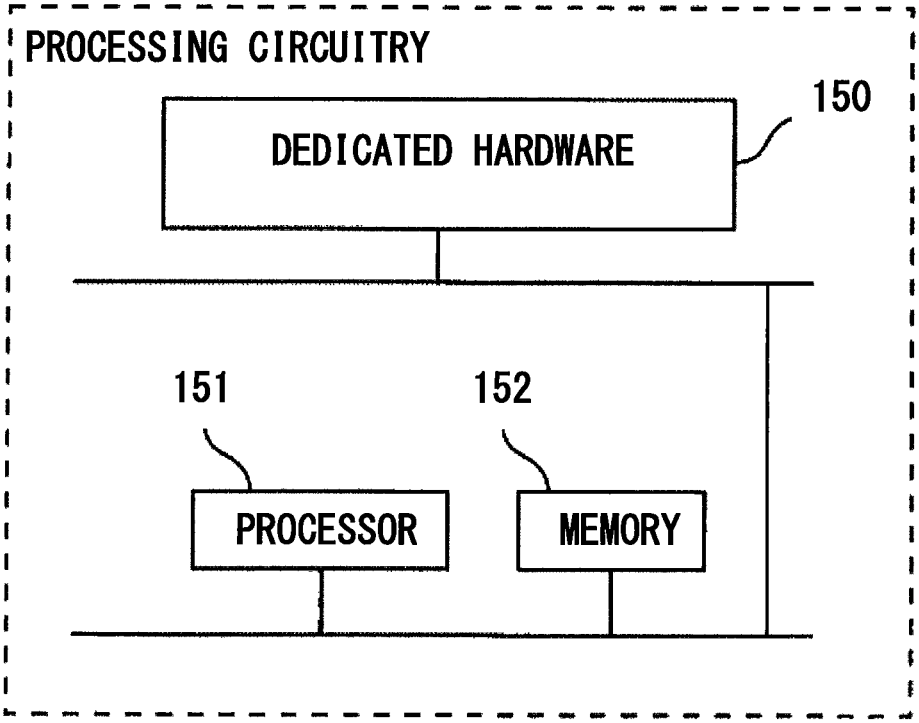
FIG. 4 is a diagram illustrating an example of a hardware configuration of a process computer in the rolling plant according to the embodiment.

Although the specific structure of the process computer 21 is not limited, the following structure may be used as an example. FIG. 4 is a diagram illustrating an example of a hardware configuration of the process computer 21 in the rolling plant 50 according to an embodiment.

The arithmetic processing function of the process computer 21 may be achieved by processing circuitry illustrated in FIG. 4. This processing circuitry may be a dedicated hardware 150. The processing circuitry may include a processor 151 and a memory 152. The processing circuitry may be partially formed of the dedicated hardware 150, and may further include the processor 151 and the memory 152. In the example of FIG. 4, a portion of the processing circuitry is formed of the dedicated hardware 150, and the processing circuitry also includes the processor 151 and the memory 152.

At least a portion of the processing circuitry may be at least one dedicated hardware 150. In this instance, processing circuits include, for example, single circuits, complex circuits, programmed processors, parallel programmed processors, ASIC, FPGA, or combinations thereof.

The processing circuitry may include at least one processor 151 and at least one memory 152. In this case, each function of the process computer 21 is achieved by software, firmware, or a combination of software and firmware. Software and firmware are written as programs and stored in the memory 152. The processor 151 reads and executes the program stored in the memory 152 to achieve each function of each part.

The processor 151 is also referred to as CPU (Central Processing Unit), central processing unit, processing unit, arithmetic unit, microprocessor, microcomputer, or DSP. The memory 152 includes, for example, non-volatile or volatile semiconductor memories such as RAMs, ROMs, flash memories, EPROM, EEPROM, and the like.

In this manner, the processing circuitry can achieve each function of the process computer 21 by hardware, software, firmware, or a combination thereof.

[Method of Calculating Plate Thickness Schedule in the Embodiment]

In order to achieve a desired target plate thickness commanded by the rolling instruction, a plate thickness schedule of the finishing rolling mill 57 is calculated based on a mathematical formula model. The plate thickness schedule includes each delivery side plate thickness in each of the rolling stands $F_1$ to $F_5$. This mathematical model is a group of mathematical formulas for estimating each temperature, each roll force, each rolling torque and the like in each of the rolling stands $F_1$ to $F_5$.

A force ratio $\gamma_i$ is used in a plate thickness schedule calculation based on a force ratio distribution method. The force ratio $\gamma_i$ is a distribution ratio of force $P_i$ in each rolling stand $F_1$ to $F_5$.

The outline of the "force ratio distribution method" will now be described. Roll force is one of factors that change an amount of plate crown, and the higher the roll force of a stand, the larger the amount of plate crown on the delivery side of the stand. Therefore, in order to reduce a crown ratio change and to keep good flatness, it is desirable that each roll force changes in the same way at each stand. However, each roll force in each stand is changed every moment for each piece of the rolling material due to variations in rolling material temperature or the like, and thereby flatness may be deteriorated. Therefore, a plate thickness schedule calculation method has been devised to keep the ratio of the roll force (i.e. a roll force ratio) as constant as possible by automatically adjusting each delivery side plate thickness of each stand even if such variation in the rolling material temperature occurs. This calculation method makes it possible to suppress the deterioration of the flatness since each stand has the almost same tendency of increase and decrease in the roll force when the roll force fluctuates due to some disturbance. Such a plate thickness schedule calculation method is called the "force ratio distribution method".

The force ratio $\gamma_i$ is defined as follows. Incidentally, "N" is the number of rolling stands, and N=5 is satisfied in the case of the finishing rolling mill 57. Also, "i" is an identifier that distinguishes a plurality of the rolling stands $F_1$ to $F_5$. A rolling stand number (i=1 to N) in the finishing rolling mill 57 is substituted into the "i."

[Expression 1]

$$P_1:P_2:\ldots:P_N=\gamma_1:\gamma_2:\ldots:\gamma_N \tag{1}$$

Incidentally, this formula (1) is equivalent to the formula (2) to be described later. The value u in equation (2) shows the relationship between the force ratio and the load value. This value "u" is a common value in each rolling stand $F_1$ to $F_5$. In the following description, the value "u" is also referred to as a "roll force term u", for convenience.

[Expression 2]

$$\frac{P_1}{\gamma_1}=\frac{P_2}{\gamma_2}=\ \ldots\ =\frac{P_N}{\gamma_N}=u \tag{2}$$

Numerical value which the force ratio $\gamma_i$ is required to satisfy is also referred to as a force ratio table value $\gamma_i^{TBL}$ for convenience. In an actual machine, the process computer 21 stores the force ratio table value $\gamma_i^{TBL}$ in a form of a number table (look-up table), for example. This number table is retrieved at a timing when setting calculation is actually executed.

Incidentally, a table value may be configured to be finely adjustable by an operator. A mechanism of the fine adjustment may be configured such that an inputted offset value $\gamma_i^{OFS}$ is added to the table value when the operator inputs an offset value $\gamma_i^{OFS}$ into the interface monitor 21*a* in the setting calculation. According to this fine adjustment function, a target value $\gamma_i^{AIM}$ of the force ratio used in the plate thickness schedule calculation can be calculated by the following formula (3).

[Expression 3]

$$\gamma_i^{AIM}=\gamma_i^{TBL}+\gamma_i^{OFS} \tag{3}$$

A "volume velocity constant law" is satisfied in each delivery side plate thickness and each roll peripheral speed of each rolling stand $F_1$ to $F_5$. The volume velocity constant law is also referred to as a "mass flow constant speed." This is because to maintain speed alignment between rolling stands. The mass flow constant law can be expressed by the following equation (4).

[Expression 4]

$$(1+f_i)\cdot h_i\cdot V_i=U \tag{4}$$

Where, $f_i$ is a forwarding rate (–) in an i-th rolling stand $F_i$. $h_i$ is the delivery side plate thickness (mm) in the i-th rolling stand $F_i$, $V_i$ is roll peripheral speed (m/s) in the i-th rolling stand $F_i$, U is volume speed (mm·m/s).

The formulas (2) and (4) show conditions that the delivery side plate thickness hi and the roll peripheral speed $V_i$ should satisfy in each rolling stands F1 to F5. The number of condition equations is 2N. There are various methods to solve the nonlinear simultaneous equation numerically. However, it is preferable that the solution be acquired in a short time in view of application to online calculation.

Therefore, the embodiment uses Newton-Raphson method which is a method with relatively small computational burden. Hereinafter, solution algorithm thereof is explained. Each of the formulas (2) and (4) consists of N equations, and 2N equations are given in total.

Variable values are an entry side plate thickness $h_0$ in a first stage rolling stand $F_1$, each delivery side plate thickness $h_1$ to $h_N$ in each rolling stand $F_1$ to $F_5$, each roll peripheral speed $V_1$ to $V_N$, a mass flow term U, and the roll force term u. Known values are the entry side plate thickness $h_0$ (mm) in the first stage rolling stand $F_1$ and the delivery side target plate thickness $h_N$ (mm) in a final rolling stand $F_5$. In contrast, since each delivery side target plate thickness in each rolling stand $F_1$ to $F_4$ is unknown, N–1 values of delivery side plate thickness are unknown.

With respect to the roll peripheral speed, speed $V_N$ (mps) in the final rolling stand $F_N$ is known. That is, the speed $V_5$ in the rolling stands $F_5$ is known in the embodiment. $V_N$ is separately determined so that the delivery side temperatures in the final rolling stand $F_N$ matches a target value thereof. In contrast, the remaining N–1 values of the roll peripheral speed are unknown. Since each of the volume velocity U and the roll force term u is also unknown, these values are added to the delivery side target plate thickness and the roll peripheral speed, and thus there are 2N unknown variable values in total.

The formulas (2) and (4) consist of 2N equations in total for 2N unknown variable values. Therefore, these formulas can be solved by Newton-Raphson method. The vector x of these unknown variable values is defined by the following formula (5).

[Number 5]

$$x=[h_1h_2h_3 \ldots h_{N-1}V_1V_2V_3 \ldots V_{N-1}Uu]^T \tag{5}$$

When calculation is started, an initial value is given to the unknown variable vector x in the formula (5). Although this initial value does not affect solution itself but affects convergence of iterative calculations. Therefore, the initial value may be given by a numerical table or a simplified formula with reference to values acquired when rolling similar products in the past.

An evaluation function vector g is introduced to solve the formulas (2) and (4) by the Newton Raphson method. When the formulas (2) and (4) are converted as follows, this provides an evaluation function $g_i$ and an evaluation function $g_{i+N}$ for evaluating error.

[Expression 6]

$$g_i = (1 + f_i) \cdot h_i \cdot V_i - U \tag{6}$$

[Expression 7]

$$g_{i+N} = \frac{P_i}{\gamma_i^{AIM} \cdot u} - 1 \tag{7}$$

The unknown variable vector x is repeatedly modified so that all of the evaluation function $g_i$ and evaluation function $g_{i+N}$ are close to 0.

Here, when each of the formula (6) and the formula (7) are the evaluation function vector g, the evaluation function vector g is expressed as follows.

[Expression 8]

$$g=[g_1g_2g_3 \ldots g_{2N}]^T \tag{8}$$

The Newton Raphson method in vector form is expressed as follows. It should be noted that "n" is the number of iterations of convergence calculation.

[Expression 9]

$$J\cdot(x_{n+1}-x_n)+g(x_n)=0 \tag{9}$$

J is a Jacobian matrix. The Jacobian matrix J is a matrix having 2N×2N dimensions, as shown in a formula (10). Since N=5 is satisfied in the embodiment as an example, the matrix is a 10×10 matrix.

[Expression 10]

$$J = \begin{bmatrix} \frac{\partial g_1}{\partial x_1} & \frac{\partial g_1}{\partial x_2} & \frac{\partial g_1}{\partial x_3} & \cdots & \frac{\partial g_1}{\partial x_{2N}} \\ \frac{\partial g_2}{\partial x_1} & \frac{\partial g_2}{\partial x_2} & \frac{\partial g_2}{\partial x_3} & \cdots & \frac{\partial g_2}{\partial x_{2N}} \\ \frac{\partial g_3}{\partial x_1} & \frac{\partial g_3}{\partial x_2} & \frac{\partial g_3}{\partial x_3} & \cdots & \frac{\partial g_3}{\partial x_{2N}} \\ \vdots & \vdots & \vdots & \ddots & \vdots \\ \frac{\partial g_{2N}}{\partial x_1} & \frac{\partial g_{2N}}{\partial x_2} & \frac{\partial g_{2N}}{\partial x_3} & \cdots & \frac{\partial g_{2N}}{\partial x_{2N}} \end{bmatrix} \tag{10}$$

Each partial differential term contained in the Jacobian matrix J is obtained as an analytic solution or a numerical derived function. Detailed calculation will be described later.

Now it will be described for a case in which five rolling stands $F_1$ to $F_5$ are provided in a rolling line as an example. The unknown variable vector x is shown in a formula (11) and a non-zero component of the Jacobian matrix J is shown in a formula (12).

[Expression 11]

$$x = [h_1h_2h_3h_4V_1V_2V_3V_4U\,u]^T \tag{11}$$

[Expression 12]

$$J = \begin{bmatrix} \frac{\partial g_1}{\partial h_1} & & & & \frac{\partial g_1}{\partial V_1} & & & & \frac{\partial g_1}{\partial U} & \\ \frac{\partial g_2}{\partial h_1} & \frac{\partial g_2}{\partial h_2} & & & & \frac{\partial g_2}{\partial V_2} & & & \frac{\partial g_2}{\partial U} & \\ & \frac{\partial g_3}{\partial h_2} & \frac{\partial g_3}{\partial h_3} & & & & \frac{\partial g_3}{\partial V_3} & & \frac{\partial g_3}{\partial U} & \\ & & \frac{\partial g_4}{\partial h_3} & \frac{\partial g_4}{\partial h_4} & & & & \frac{\partial g_4}{\partial V_4} & \frac{\partial g_4}{\partial U} & \\ & & & \frac{\partial g_5}{\partial h_4} & & & & & \frac{\partial g_5}{\partial U} & \\ \frac{\partial g_6}{\partial h_1} & & & & \frac{\partial g_6}{\partial V_1} & & & & & \frac{\partial g_6}{\partial u} \\ \frac{\partial g_7}{\partial h_1} & \frac{\partial g_7}{\partial h_2} & & & & \frac{\partial g_7}{\partial V_2} & & & & \frac{\partial g_7}{\partial u} \\ & \frac{\partial g_8}{\partial h_2} & \frac{\partial g_8}{\partial h_3} & & & & \frac{\partial g_8}{\partial V_3} & & & \frac{\partial g_8}{\partial u} \\ & & \frac{\partial g_9}{\partial h_3} & \frac{\partial g_9}{\partial h_4} & & & & \frac{\partial g_9}{\partial V_4} & & \frac{\partial g_9}{\partial u} \\ & & & \frac{\partial g_{10}}{\partial h_4} & & & & & & \frac{\partial g_{10}}{\partial u} \end{bmatrix} \tag{12}$$

In the embodiment, an inverse matrix $J^{-1}$ of the Jacobian matrix J is also calculated. Gaussian sweeping method, LU decomposition method and the like are known as calculation methods of the inverse matrix, and those methods can be used.

According to the formula (9), the unknown variable vector x is updated as follows using the inverse matrix $J^{-1}$.

[Expression 13]

$$x_{n+1}=x_n-J^{-1}\cdot g(x_n) \tag{13}$$

Computation continues until an error in n-th iteration is less than a tolerance $\varepsilon_c$. A final value of the unknown-variable vector $x_n$ satisfies both formulas (2) and (4) at the same time.

Convergence determination condition of repeat calculation is to satisfy both the following formula (14a) and formula (14b).

[Expression 14]

$$\max_{i=1\ldots N} |g_i| \leq \epsilon_c \tag{14a}$$

[Expression 15]

$$\max_{i=1\ldots N} |g_{i+N}| \leq \epsilon_c \tag{14b}$$

A convergence condition $\varepsilon_c$ in the right-hand is set to be sufficiently smaller than required computational accuracy. The Convergence condition $\varepsilon_c$ may be, for example, about 0.001.

(Modification: Power Ratio Distribution Method)

Although the embodiment implements calculation based on the force ratio distribution method, instead thereof, a plate thickness schedule calculation based on a power ratio distribution method may be implemented as a modification.

Outline of the "power ratio distribution method" will now be explained. The power ratio distribution method is a calculation method to calculate the plate thickness schedule so that a ratio of power in each stand is kept as constant as possible. The power ratio distribution method uses motor power (electric power). The motor power is correlated with the roll force, and actual values thereof can be acquired from a drive device of a motor.

In the force ratio distribution method and the power ratio distribution method, the calculation contents of both are almost the same, but the following points differ.

In the plate thickness schedule calculation by the power ratio distribution method, a power ratio $\gamma_i$ is used. The power ratio $\gamma_i$ is a distribution ratio of motor power $P_{wi}$ at each rolling stand $F_1$ to $F_5$. In this modification, the following formula (15) is used in place of the formula (1).

[Expression 16]

$$P_{W1}:P_{W2}:\ldots:P_{WN}=\gamma_1:\gamma_2:\ldots:\gamma_N \tag{15}$$

The formula (15) is equivalent to the following formula (16). In this modification, the following formula (16) is used in place of the formula (2). The formula (16) includes "u" which defines relationship between the power ratio and a power value. A common value is used for u in each rolling stand $F_1$ to $F_5$. In equation (16), u is also a motor power term.

[Expression 17]

$$\frac{P_{W1}}{\gamma_1}=\frac{P_{W2}}{\gamma_2}=\ldots=\frac{P_{WN}}{\gamma_N}=u \tag{16}$$

In the present modification using the power ratio distribution method, the following formula (17) is also used for the evaluation function $g_{i+N}$ instead of the formula (7).

[Expression 18]

$$g_{i+N}=\frac{P_{Wi}}{\gamma_i^{AIM}\cdot u}-1 \tag{17}$$

A method for calculating a derived function for a Jacobian matrix will be described later.

(Direct Designation of Reduction Rate)

Next, direct designation of the reduction rate $r_i$ for arbitrary rolling stand will now be described. The process computer 21 stores the target value $r_i^{TBL}$ of the reduction rate in a form of the number table (specifically, the look-up table). The look-up table may have categories such as steel grade and target plate thickness.

The $r_i^{TBL}$ is also referred to as a "look-up table reference value". This table is retrieved when actual setting-up calculation is performed. It should be noted that, if the look-up table reference value $r_i^{TBL}$ is zero, it may be regarded that the target value is not instructed.

An operator can input an operator reduction rate instruction value $r_i^{OP}$ via the interface monitor 21*a*. When the input occur, the operator reduction rate instruction value $r_i^{OP}$ is treated as a target value $r_i^{AIM}$ of the reduction rate. When the operator reduction rate instruction value $r_i^{OP}$ is zero, it may be regarded that the target value is not instructed.

Therefore, the following formula calculates the reduction rate target value $r_i^{AIM}$ used in calculating the plate thickness schedule.

[Expression 19]

$$r_i^{AIM}=r_i^{TBL}(r_i^{TBL}>0) \tag{18}$$

[Expression 20]

$$r_i^{AIM}=r_i^{OP}(r_i^{OP}>0) \tag{19}$$

It should be noted that when $r_i^{TBL}=0$ and $r_i^{OP}=0$, it is treated as if there is no instruction to the reduction rate specification. Further, when $r_i^{TBL}>0$ and $r_i^{OP}>0$, $r_i^{OP}$ is used.

In the plate thickness schedule calculation, first, the process computer 21 sequentially checks whether each reduction rate is instructed in each rolling stand $F_1$ to $F_5$.

If a reduction rate is instructed in the j-th rolling stand, the rolling stand $F_j$ is not subject to the force ratio distribution method and the rolling stand $F_j$ is controlled based on the instructed reduction rate. Specifically, the formula (7) about the force ratio is replaced with the following formula (20). The formula (20) represents a constraint on the reduction rate. $r_j^{AIM}$ is a reduction rate instruction value for the j-th stand.

[Expression 21]

$$g_{j+N}=\frac{h_j}{(1-r_j^{AIM})\cdot h_{j-1}}-1 \tag{20}$$

As an example, it is assumed that a reduction rate instruction has been made to the third rolling stand $F_3$ in the rolling plant 50. In this case, since N=5 and j=3, $g_8$ is replaced with the following formula (21) in the evaluation function vector g of the formula (8).

[Expression 22]

$$g_8 = \frac{h_3}{(1 - r_3^{AIM}) \cdot h_2} - 1 \tag{21}$$

(Limit Exceeding Determination)

In addition, the process computer 21 sequentially checks whether or not each rolling stand $F_1$ to $F_5$ has an item which has exceeded a limit value. If the limit exceeding occurs in the j-th rolling stand $F_j$, the rolling stand $F_j$ is not subject to the force ratio distribution method and the rolling stand $F_j$ is controlled based on the limit value. Specifically, the formula (7) about the force ratio is replaced with each of the following formulas. Each formula below represents each constraint on each item exceeding each limit.

(a) Roll Force Limit

A formula (22) defines determination condition of exceeding a roll force limit. Where, $P_j^{MAX}$ is a force limit value and Ep is a margin rate. The margin rate $\varepsilon_P$ may be set to be, for example, about several percent.

[Expression 23]

$$P_j > (1+\epsilon_P) \cdot P_j^{MAX} \tag{22}$$

When the roll force limit is exceeded, the formula (7) is replaced with the following formula (23).

[Expression 24]

$$g_{j+N} = \frac{P_j}{P_j^{MAX}} - 1 \tag{23}$$

(b) Motor Power Limit

A formula (24) is determination condition of exceeding a motor power limit. Where, $P_{wj}^{MAX}$ is a force limit value and $\varepsilon_{PW}$ is a margin rate. The margin rate $\varepsilon_{PW}$ may be set to be, for example, about several percent.

[Expression 25]

$$P_{wj} > (1+\epsilon_{PW}) \cdot P_{Wj}^{MAX} \tag{24}$$

When the roll force limit is exceeded, Equation (7) is replaced by the following formula (25).

[Expression 26]

$$g_{j+N} = \frac{P_{Wj}}{P_{Wj}^{MAX}} - 1 \tag{25}$$

(c) Reduction Rate Limit

A formula (26) is determination condition of exceeding a reduction rate limit. Where, $r_j^{MAX}$ is a reduction rate limit value, and $\varepsilon_r$ is a margin ratio. The margin ratio $\varepsilon_r$ may be set to be, for example, about several percent.

[Expression 27]

$$r_j > (1+\epsilon_r) \cdot r_j^{MAX} \tag{26}$$

When the reduction rate limit is exceeded, the formula (7) is replaced with a formula (27).

[Expression 28]

$$g_{j+N} = \frac{r_j}{r_i^{MAX}} - 1 \tag{27}$$

Incidentally, once the limit exceeding has been determined in the course of repeated calculation, it may be considered that the limit exceeding continues as long as the force distribution ratio or the power distribution ratio is less than an instructed distribution ratio.

The evaluation function g obtained thereby is applied to the formula (10), and thus the Jacobian matrix J can be acquired in consideration of the reduction rate instruction and the limit exceeding. The Jacobian matrix J is applied to the formula (13) and the like, and thereby convergence calculation is executed. Thus, solution of the unknown variable vector x is calculated in the same calculation manner when there are no reduction rate instruction and no limit check.

The process computer 21 displays a plate thickness schedule calculation result on the interface monitor 21*a*. The plate thickness schedule calculation result includes the entry side plate thickness of the first stage rolling stand $F_1$ given in advance, each delivery side plate thickness in each rolling stand $F_1$ to $F_5$ included in the unknown variables vector x, and the delivery side plate thickness of the final rolling stand $F_5$ given in advance. The process computer 21 outputs the setting value to a lower controller in accordance with these calculation results.

(Details of Derived Function)

Incidentally, each term of the derived function included in the Jacobian matrix J of the above-described equation (10) is calculated as follows. Hereinafter, configuration of the Jacobian matrix J will also be described with reference to FIG. 2. FIG. 2 is a diagram for explaining a configuration of the Jacobian matrix J used in the plate thickness schedule calculation method according to the embodiment. The Jacobian matrix J contains a first component group $MX_1$ and a second component group $MX_2$. The first component group $MX_1$ is components of a first row to N-th rows in the Jacobian matrix J. The second component group $MX_2$ is components of N+1-th row to 2N-th row in the Jacobian matrix J.

The components of the first component group $MX_1$ in FIG. 2 are mass flow terms. The mass flow terms are defined as in the following formulas (28) to (31).

[Expression 29]

$$\frac{\partial g_i}{\partial h_{i-1}} = \frac{h_i \cdot V_i}{U} \cdot \left( \frac{f_i \cdot (h_{i-1} + \Delta h_{i-1}) - f_i \cdot (h_{i-1} - \Delta h_{i-1})}{2 \cdot \Delta h_{i-1}} \right) \tag{28}$$

[Expression 30]

$$\frac{\partial g_i}{\partial h_i} = \frac{h_i \cdot V_i}{U} \cdot \left( \frac{1 + f_i}{h_i} + \frac{f_i \cdot (h_i + \Delta h_i) - f_i \cdot (h_i - \Delta h_i)}{2 \cdot \Delta h_i} \right) \tag{29}$$

[Expression 31]

$$\frac{\partial g_i}{\partial V_i} = \frac{h_i \cdot (1 + f_i)}{U} \tag{30}$$

-continued

[Expression 32]

$$\frac{\partial g_i}{\partial U} = -\frac{h_i \cdot V_i \cdot (1 + f_i)}{U^2} \tag{31}$$

Incidentally, each infinitesimal difference $\Delta h_{i-1}$ and $\Delta h_i$ in numerical differentiation may be less than 1% of the thickness of the delivery side plate in the i-th rolling stand $F_i$.

Each component of the second component group $MX_2$ in FIG. 2 becomes a force ratio term when the force ratio distribution method is implemented, and becomes a power ratio term when the power ratio distribution method is implemented.

Force ratio terms are defined as in the following formulas (32) to (35).

[Expression 33]

$$\frac{\partial g_{i+N}}{\partial h_i} = \frac{1}{\gamma_i^{AIM} \cdot u} \cdot \frac{P_i(h_i + \Delta h_i) - P_i \cdot (h_i - \Delta h_i)}{2 \cdot \Delta h_i} \tag{32}$$

[Expression 34]

$$\frac{\partial g_{i+N}}{\partial h_{i-1}} = \frac{1}{\gamma_i^{AIM} \cdot u} \cdot \frac{P_i(h_{i-1} + \Delta h_{i-1}) - P_i \cdot (h_{i-1} - \Delta h_{i-1})}{2 \cdot \Delta h_{i-1}} \tag{33}$$

[Expression 35]

$$\frac{\partial g_{i+N}}{\partial V_i} = \frac{1}{\gamma_i^{AIM} \cdot u} \cdot \frac{P_i(V_i + \Delta V_i) - P_i(V_i - \Delta V_i)}{2 \cdot \Delta V_i} \tag{34}$$

[Expression 36]

$$\frac{\partial g_{i+N}}{\partial u} = -\frac{P_i}{\gamma_i^{AIM} \cdot u^2} \tag{35}$$

In addition, infinitesimal difference $\Delta V_i$ in numerical differentiation may be less than 1% of roll peripheral speed $V_i$ in the i-th rolling stand $F_i$.

Power ratio terms are defined as in the following formulas (36) to (39).

[Expression 37]

$$\frac{\partial g_{i+N}}{\partial h_i} = \frac{1}{\gamma_i^{AIM} \cdot u} \cdot \frac{P_{wi}(h_i + \Delta h_i) - P_{wi} \cdot (h_i - \Delta h_i)}{2 \cdot \Delta h_i} \tag{36}$$

[Expression 38]

$$\frac{\partial g_{i+N}}{\partial h_{i-1}} = \frac{1}{\gamma_i^{AIM} \cdot u} \cdot \frac{P_{wi}(h_{i-1} + \Delta h_{i-1}) - P_{wi} \cdot (h_{i-1} - \Delta h_{i-1})}{2 \cdot \Delta h_{i-1}} \tag{37}$$

[Expression 39]

$$\frac{\partial g_{i+N}}{\partial V_i} = \frac{1}{\gamma_i^{AIM} \cdot u} \cdot \frac{P_{wi}(V_i + \Delta V_i) - P_{wi}(V_i - \Delta V_i)}{2 \cdot \Delta V_i} \tag{38}$$

[Expression 40]

$$\frac{\partial g_{i+N}}{\partial u} = -\frac{P_{wi}}{\gamma_i^{AIM} \cdot u^2} \tag{39}$$

(Derived Function with Parameter Restriction)

It is assumed that the reduction rate instruction or the limit exceeding has occurred at any rolling stand. The reduction rate instruction and the limit exceeding are collectively referred to as "parameter restriction." Components in the second component group $MX_2$ of a particular rolling stand which experiences the parameter restriction are replaced as follows depending on the type of restriction. With respect to the other rolling stand in which neither the reduction rate specification nor the limit exceeding has occurred, an original force ratio term or an original power ratio term is maintained, and component replacement is not executed.

(i) Derived function used when the reduction rate instruction has occurred.

The following formulas (40) to (43) are used for each rolling stand in which the reduction rate is instructed.

[Expression 41]

$$\frac{\partial g_{i+N}}{\partial h_i} = \frac{1}{(1 - r_i^{AIM}) \cdot h_{i-1}} \tag{40}$$

[Expression 42]

$$\frac{\partial g_{i+N}}{\partial h_{i-1}} = \frac{-h_i}{(1 - r_i^{AIM}) \cdot (h_{i-1})^2} \tag{41}$$

[Expression 43]

$$\frac{\partial g_{i+N}}{\partial V_i} = 0 \tag{42}$$

[Expression 44]

$$\frac{\partial g_{i+N}}{\partial u} = 0 \tag{43}$$

(ii) Derived function used when the limiter exceeding has occurred.

The limiter exceeding may occur in each of the roll force $P_i$, the motor power $P_{wi}$ and the reduction rate $r_i$.

First, if the roll force $P_i$ in a certain rolling stand exceeds a limit value, the following formulas (44) to (47) are used for the certain rolling stand. Among these formulas, each of the formulas (44) through (46) contains a maximum value $P_i^{MAX}$ which is set for occurrence of the limit exceeding.

[Expression 45]

$$\frac{\partial g_{i+N}}{\partial h_i} = \frac{1}{P_i^{MAX}} \cdot \frac{P_i(h_i + \Delta h_i) - P_i \cdot (h_i - \Delta h_i)}{2 \cdot \Delta h_i} \tag{44}$$

[Expression 46]

$$\frac{\partial h_{i+N}}{\partial h_{i-1}} = \frac{1}{P_i^{MAX}} \cdot \frac{P_i(h_{i-1} + \Delta h_{i-1}) - P_i \cdot (h_{i-1} - \Delta h_{i-1})}{2 \cdot \Delta h_{i-1}} \tag{45}$$

[Expression 47]

$$\frac{\partial g_{i+N}}{\partial V_i} = \frac{1}{P_i^{MAX}} \cdot \frac{P_i(V_i + \Delta V_i) - P_i(V_i - \Delta V_i)}{2 \cdot \Delta V_i} \tag{46}$$

[Expression 48]

$$\frac{\partial g_{i+N}}{\partial u} = 0 \tag{47}$$

If the motor power $P_{wi}$ of a certain rolling stand exceeds a limit value, the following formulas (48) to (51) are used for the certain rolling stand. Among these formulas, each of the formulas (48) through (50) contains a maximum value $P_{wi}^{MAX}$ which is set for occurrence of the limit exceeding.

[Expression 49]

$$\frac{\partial g_{i+N}}{\partial h_i} = \frac{1}{P_{Wi}^{MAX}} \cdot \frac{P_{Wi}(h_i + \Delta h_i) - P_{Wi} \cdot (h_i - \Delta h_i)}{2 \cdot \Delta h_i} \quad (48)$$

[Expression 50]

$$\frac{\partial g_{i+N}}{\partial h_{i-1}} = \frac{1}{P_{Wi}^{MAX}} \cdot \frac{P_{Wi}(h_{i-1} + \Delta h_{i-1}) - P_{Wi} \cdot (h_{i-1} - \Delta h_{i-1})}{2 \cdot \Delta h_{i-1}} \quad (49)$$

[Expression 51]

$$\frac{\partial g_{i+N}}{\partial V_i} = \frac{1}{P_{Wi}^{MAX}} \cdot \frac{P_{Wi}(V_i + \Delta V_i) - P_{Wi}(V_i - \Delta V_i)}{2 \cdot \Delta V_i} \quad (50)$$

[Expression 52]

$$\frac{\partial g_{i+N}}{\partial u} = 0 \quad (51)$$

If the reduction rate $r_i$ in a certain rolling stand exceeds a limit value, the following formulas (52) to (55) are used for the certain rolling stand. Among these formulas, each of the formulas (52) and (53) contains a maximum value $r_i^{MAX}$ which is set for occurrence of the limit exceeding.

[Expression 53]

$$\frac{\partial g_{i+N}}{\partial h_i} = \frac{1}{(1 - r_i^{MAX}) \cdot h_{i-1}} \quad (52)$$

[Expression 54]

$$\frac{\partial g_{i+N}}{\partial h_{i-1}} = \frac{-h_i}{(1 - r_i^{MAX}) \cdot (h_{i-1})^2} \quad (53)$$

[Expression 55]

$$\frac{\partial g_{i+N}}{\partial V_i} = 0 \quad (54)$$

[Expression 56]

$$\frac{\partial g_{i+N}}{\partial u} = 0 \quad (55)$$

For example, it is assumed that the reduction rate instruction has occurred only in the third rolling stand $F_3$. In this case, since N=5 and i=3 are satisfied in the embodiment, i+N=8 is satisfied. Therefore, each formula (40) to (43) for the reduction rate instruction is substituted only into each evaluation function g8 constituting a row $R_{i+N}(=R_8)$ in FIG. 2.

In the embodiment, the formulas (32) to (55) in the above derived functions may be distinguished and referred to as a "first derived function" and a "second derived function" for convenience of explanation. These wordings are merely for convenience of explanation, and the wordings do not limit contents therein. Incidentally, the formulas (28) to (31) of the mass flow terms are not included in the first derived function and the second derived function.

The "first derived function" is a derived function to satisfy the force ratio or the power ratio. In the embodiment, the first derived function refers to each of the formulas (32) to (35) and the formulas (36) to (39).

The "second derived function" is a predetermined derived function for setting various parameters (i.e., a reduction rate $r_i$, motor power $P_{wi}$, and force $P_i$) in accordance with the parameter restriction such as the reduction rate instruction or the limiter exceeding. In the embodiment, the second derived function refers to each of the formula (40) to (55).

The first derived function differs from the second derived function in at least the following points.

One of the differences is the presence or absence of the variable value u. In the first derived function, each formula contains the variable value u, and specifically each formulas contains $u^{-1}$. The first derived function is derived to satisfy the force ratio or the power ratio. Each formulas of the second derived function does not contain the variable value u. Both functions are different in this respect.

Another difference relates to a partial differential term of the variable value u. The variable value u is a roll force term in the formula (2) or a motor power term in the formula (16). The first derived function provides each formula (35) and (39) which is the partial differential terms of u in a form of mathematical equation. The first derived function is derived to satisfy the force ratio or the power ratio. On the other hand, the second derived function includes the formula (43), the formula (47), the formula (51) and the formula (55) which are the partial differential terms of u, and each formula is zero. In other words, the first derived function calculates the partial differential term of u, whereas the second derived function does not calculate the partial differential term of u, and both functions are different in this respect.

Further another difference is the presence or absence of the target value $\gamma_i^{AIM}$ In the first derived function, each formula contains $\gamma_i^{AIM}$, and specifically, each formula contains $1/\gamma_i^{AIM}$. In the second derived function, each formula does not include the variable $\gamma_i^{AIM}$. Instead thereof, the second derived function includes $r_i^{AIM}$, $P_i^{MAX}$ $P_{wi}^{MAX}$ and $r_i^{MAX}$ in each formula depending on the type of parameter restriction. Both functions are different in this respect.

Further another difference is feature that the second derived function has when the reduction rate instruction and the limit exceeding in the reduction rate has occurred. In the first derived function, the formulas (34) and (38), which are the partial differential terms of $V_i$, are provided as mathematical equations. In contrast, the second derived function includes the formula (42) of the partial differential term of $V_i$ at the time of the reduction rate instruction and the formula (54) of the partial differential term of $V_i$ at the time of the limit exceeding in the reduction rate, and each formula is zero. In other words, the first derived function calculates the partial differential terms of $V_i$, while the second derived function does not calculate the partial differential terms of $V_i$ when one of the reduction rate instruction and when the limit exceeding in the reduction rate has occurred, and both functions are different in this respect.

Either the first derived function or the second derived function is selectively substituted into the components of the second component group $MX_2$ of the Jacobian matrix J illustrated in FIG. 2.

Incidentally, a column $C_{10}$ in FIG. 2 includes each partial differential component of the roll force term u. It is one of the features of the embodiment that the column $C_{10}$ is included into the Jacobian matrix J.

[Details of Control in the Embodiment]

Figure 3:
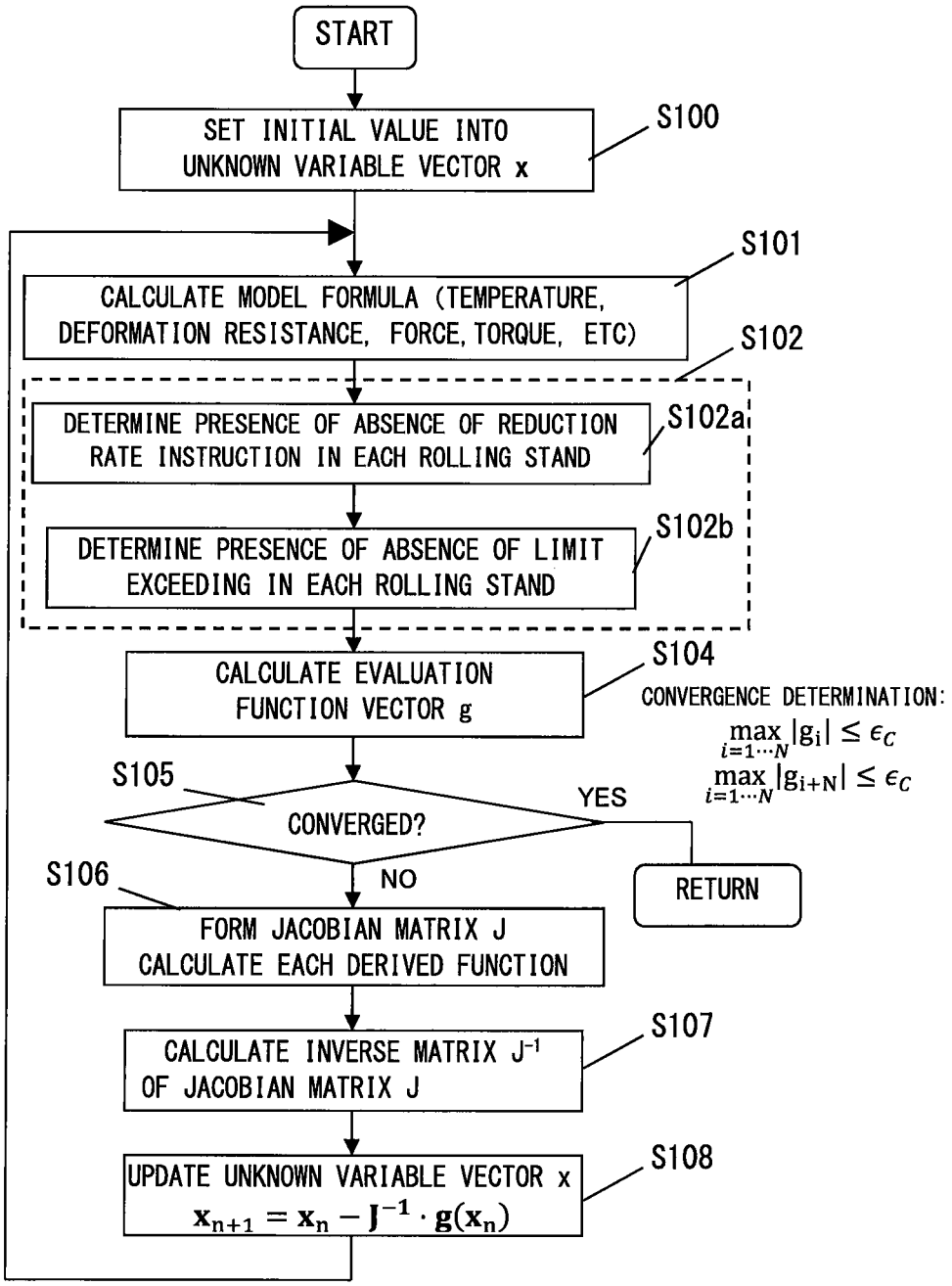
FIG. 3 is a flowchart for explaining control performed in the rolling plant according to the embodiment.

FIG. 3 is a flowchart for explaining control performed in the rolling plant 50 according to the embodiment. FIG. 3 illustrates a calculations flow for executing the plate thickness schedule calculation method described above on the process computer 21.

The process computer 21 stores a program for executing the processing in FIG. 3. In order to avoid duplicate description, the following description refers as necessary to mathematical formulas, symbols, terminology and the like in the "plate thickness schedule calculation method of the embodiment" described above.

(Step S100)

According to the control flow in FIG. 3, first, the process computer 21 sets an initial value into the derived function vector x in step S100. The derived function vector x is the formula (5) which has been described.

(Step S101)

Next, in step S101, the process computer 21 calculates a rolling model formula. The rolling model formula includes temperature of the material-to-be-rolled, deformation resistance, force $P_i$ and torque. A temperature measurement value or a temperature estimation value in 1, 52, 55 is included as the temperature of the material-to-be-rolled. The temperature of material-to-be-rolled is preferably fed back to control in the process computer 21 in real time. Each of the force distribution method and the power ratio distribution method has the following different rolling model formula.

When the force ratio distribution method is implemented, the rolling model formula includes the force ratio $\gamma_i$. The rolling model formula in this case includes the formula (2) having a roll force model (Pi) and the formula (4) having a forwarding rate model (fi).

On the other hand, when the power ratio distribution method in the modification is implemented, the rolling model formula includes the power ratio $\gamma_i$. The rolling model formula in this case includes the formula (16) having a motor power model ($P_{wi}$) and the formula (4) having the forwarding rate model ($f_i$).

In the embodiment, for convenience of explanation, the roll force ratio $\gamma_i$ and the motor power ratio $\gamma_i$ are also referred to as a "first value." Incidentally, a wording of a "load distribution ratio" is used as a generic concept word which includes the roll force ratio and the motor power ratio. The first value may be the load distribution ratio.

(Steps S102, S102*a*, S102*b*)

Next, in step S102, the process computer 21 determines whether or not the "parameter restriction" has occurred. The "parameter restriction" is that at least one parameter of the roll force $P_i$, the motor power $P_{wi}$, and the reduction rate $r_i$ in each rolling stand $F_1$ to $F_5$ is restricted for some reason.

In the embodiment, for convenience of explanation, each of the roll force $P_i$, the motor power $P_{wi}$ and the reduction rate $r_i$ is also referred to as a "second value."

Parameter restriction determination processing in step S102 includes processing (Step S102*a*) for determining a first restriction and processing (step S102*b*) for determining a second restriction. Although the embodiment includes both restricting function of the "first restriction" and the "second restriction", either one thereof may be omitted as a modification.

First, the "first restriction" will now be described. The first restriction in step S102*a* is to restrict the second value by an instruction value. There are some types of instruction values in the first restriction. Hereinafter, a first instruction value and a second instruction value are exemplified.

The first instruction value is a look-up table reference value. In the embodiment, the look-up table reference value $r_i^{TBL}$ of the reduction rate is exemplified as a specific example. Instead of or in addition to this, a look-up table reference value for each of the roll force and the motor power may be provided as necessary.

The second instruction value is an operator instruction value inputted by an operator via the interface monitor 21*a*. In the embodiment, the operator reduction rate instruction value $r_i^{OP}$ is exemplified as a specific example. Instead of or in addition to this, at least one of an operator roll force instruction value $P_i^{OP}$ and an operator motor power instruction value $P_{wi}^{OP}$ may be provided as necessary.

Next, the "second restriction" will now be described. The second restriction in step S102*b* is to restrict the second value within a predetermined limit range when the second value exceeds outside the limit range. There are some types of limit ranges used in the second restriction. Hereinafter, the first limit range and the second limit rage are exemplified.

The "first limit range" is a predetermined range defined based on a machine constant of the equipment which the rolling plant 50 includes. In contrast, "the second limit range" is predetermined to be a range different from the first limit range based on operational constraints of the rolling plant 50. The second limit range may be set narrower than the first limit range so as to fall within the first limit range.

(Step S104)

Next, in step S104, calculation processing of the evaluation function vector g is executed. First, in step S104, the process computer 21 selects one of a "model-based evaluation function" and a "modified evaluation function" in accordance with the presence or absence of the parameter restriction in step S102.

The model-based evaluation function is a name for convenience of referring to an evaluation function $g_{i+N}$ defined by the formula (7) or the formula (17). In the absence of the parameter restriction, the model-based evaluation function is selected.

The modified evaluation function is a name for convenience of referring to any one of a plurality of evaluation functions $g_{i+N}$ defined by the formulas (20), (23), (25) and (27). When the parameter restriction occur, the modified evaluation function is selectively used in accordance with the type of the parameter restriction. The modified evaluation function differs from the model-based evaluation function in that it does not include the variable value u (i.e., roll force term or motor power term) and the target value $\gamma_i^{AIM}$.

If the reduction rate instruction or the limit exceeding has occurred in a certain rolling stand, replacement of the evaluation function vector $g_{i+N}$ for the certain rolling stand is executed. Since a specific method of the replacement has been described with exemplifying the formulas (21) to (27) in the plate thickness schedule calculation method of the embodiment, the details thereof will be omitted.

In step S104, the replacement of the evaluation function vector $g_{i+N}$ is executed, and thereafter calculation on the replaced evaluation function vector is executed.

(Step S105)

Next, in step S105, the process computer 21 executes convergence determination based on the formulas (14a) and (14b) by using step S104's calculation results from the evaluation functions $g_i$ and $g_{i+N}$. If both conditions in the formulas (14a) and (14b) are satisfied, then processing exits a loop, and thereafter processing in FIG. 3 returns to a main routine (not illustrated) as described later.

(Steps S106, S107)

If the convergence determination condition is not satisfied in step S105, in step S106, the process computer 21 constitutes the Jacobian matrix J and then the process computer 21 calculates each derived function (each partial differential term) which is each component thereof.

The configuration of the Jacobian matrix J varies according to the result of the parameter restriction determination in step S102. Specifically, if no parameter restriction occurs in step S102, the first derived function (i.e., the formulas (32) to (35) or the formulas (36) to (39)) is selected as components of the Jacobian matrix J in step S106. On the other hand, when the parameter restriction occurs in step S102, the second derived function (i.e., the formulas (40) to (55)) is selected as components of the Jacobian matrix J in accordance with the type of the restriction.

In the embodiment, when the evaluation function is selected in step S104 described above, the derived function of the Jacobian matrix J in step S106 is also determined accordingly. This is because the model-based evaluation function relates to the first derived function, and the modified evaluation function relates to the second derived function. The process computer 21 constructs the Jacobian matrix J to include the derived function selected in step S106 from the first derived function and the second derived function. Thereafter, calculation on each derived function included in the Jacobian matrix J is executed.

In next step S107, the process computer 21 calculates the inverse matrix $J^{-1}$ of the Jacobian matrix J computed in step S106.

(Step S108)

Next, in step S108, the process computer 21 corrects the delivery side plate thickness in each rolling stand $F_1$ to $F_5$. Specifically, the unknown variable vector x is updated according to the formula (13) by using the inverse matrix $J^{-1}$ calculated in step S107.

Processing is then returned to the main routine which is not illustrated. After the processing is returned from the subroutine to the main routine in the plate thickness schedule calculation, the plate thickness is used to execute calculation processing of various models. Based on the results of this calculation, through the network, actuator setting values are outputted to the controller 22.

The embodiment described above makes it possible to change functions (evaluation function g and its derived function) used in the plate thickness schedule calculation depending on whether or not the parameter restriction (step S102) relating to rolling process has occurred. When the parameter restriction occur, excessive computation time or excessive computation impossibility is caused to calculate solution thereof based on the model-based evaluation function depending on the situation, and therefore the convergence condition may not be satisfied and the plate thickness schedule calculation may stagnate. In this regard, since the embodiment appropriately modifies the calculation contents, it is possible to suppress stagnation of the plate thickness schedule calculation.

With respect to step S102*a*, the process computer 21 may be configured to accept both the first and second instruction values, or may be configured to accept only one instruction value of the first and second instruction values.

With respect to step S102*b*, the process computer 21 may have both the first limit range and the second limit range, or may have only one limit range of the first limit range and the second limit range.

In the control flow in FIG. 3, step S102 includes a plurality kinds of parameter restrictions consisting of the first restriction and the second restriction. In this case, prioritization of parameter restrictions may be defined, and it may be configured that higher priority restriction is executed when plural kinds of restriction occur.

Hereinafter, variations of the prioritization will now be described. In the following description, for convenience, the prioritization will be described using inequality signs. When "restriction A>restriction B" is stated, priority of the restriction A is relatively high.

For example, "the first restriction>the second restriction" may be set, or vice versa. In the first restriction, "the operator instruction value>the look-up table reference value" may be set, that is $r_i^{OP}$ may be prioritized rather than $r_i^{TBL}$. However, the order of priority may be reversed. In the second restriction, a narrower limit range of the first limit range and the second limit range may be prioritized.

A plurality types of first restriction and a plurality types of second restriction may be intermixed. As an example of intermixing, prioritization may be defined in the order "the operator instruction value>the second limit range>the look-up table reference value>the first limit range." The above prioritization may disregard restriction which the rolling plant 50 does not have among the operator instruction value, the look-up table reference value, and the second limit range, and the first limit range.

Incidentally, from the viewpoint of equipment maintenance or operation efficiency, when parameters are instructed so as to exceed the first limit range or the second limit range, the instruction may be disregarded.

Other known solutions or other known root solving algorithms for solving nonlinear simultaneous equations may be used instead of the Newton Raphson method. Other than the Newton Raphson method, the solution of the unknown variable vector may be calculated using Gaussian sweeping method, for example, as a modification.

Incidentally, the plate thickness schedule calculation method and the specific control according to the above embodiment may be modified to change order of the calculation or order of the steps therein, except when the order relationship thereof is clearly defined.

REFERENCE SIGNS LIST

1 Material-to-be-rolled (strip)
5 Roll gap control device
6 Roll force sensor
7 Electric motor
20 Host computer
21 Process computer
21*a* Interface monitor
22 Controller
50 Rolling plant
51 Material-to-be-rolled (slab)
52 Heating furnace
53 Roughing mill
54 Bar heater
55 Material-to-be-rolled (bar)
56 Entry side temperature pyrometer
57 Finishing mill
58 Plate thickness width gauge
59 Delivery side pyrometer
61 Winder
62 Coil product
63 Water cooling equipment
150 Dedicated hardware
151 Processor
152 Memory
$F_1$ Rolling stand (first stage rolling stand)
$F_2$ to $F_4$ Rolling stand
$F_5$ (final rolling stand)
$F_i$ Rolling stand (i-th rolling stand)
$F_j$ Rolling stand (j-th rolling stand)
g Evaluation function (evaluation function vector)
$g_i$, $g_{i+N}$ Evaluation function (evaluation function or evaluation function vector for i-th rolling stand)
$h_0$ Entry side plate thickness
$h_1$ to $h_N$ Delivery side plate thickness $h_1$ Delivery side plate thickness (delivery side plate thickness of i-th rolling stand)
$MX_1$ First component group
$MX_2$ Second component group
$P_i$ Force (roll force)
$P_i^{MAX}$ Maximum value
$P_{wi}$ Motor power
$r_i$ Reduction rate
x Unknown variable vector
$\varepsilon_c$ Convergent condition

The invention claimed is:

1. A method for calculating plate thickness schedule for a tandem rolling mill comprising:

acquiring a rolling model formula including a first value, the first value being one of a roll force ratio and a motor power ratio for each of a plurality of rolling stands;

determining whether or not a second value is restricted by parameter restriction, the second value being at least one value of roll force, motor power, and a reduction rate in each of the rolling stands;

selecting one derived function from a first derived function and a second derived function to use the one derived function as a derived function of an evaluation function, the evaluation function evaluating an error based on the first value, the first derived function being a function configured to satisfy a ratio of the first value, the second derived function being defined in advance so that the second value is set in accordance with the parameter restriction, each derived function for each rolling stand being selected in accordance with a result of the determination so that the first derived function is selected when the parameter restriction does not occur and the second derived function is selected when the parameter restriction occurs; and modifying each delivery side plate thickness in each rolling stand using a matrix including the one derived function selected from the first derived function and the second derived function in accordance with the result of the determination.

2. The method for calculating plate thickness schedule for the tandem rolling mill according to claim 1, wherein the parameter restriction includes at least one of first restriction to restrict the second value based on an instruction value, and second restriction to restrict the second value within a predetermined limit range when the second value exceeds outside the limit range.

3. The method for calculating plate thickness schedule for the tandem rolling mill according to claim 1, wherein the matrix is configured in a form of a Jacobian matrix, and the method further comprising acquiring an unknown variable vector including each unknown variable which is each delivery side plate thickness in each rolling stand, and modifying each delivery side plate thickness in each rolling stand by solving the unknown variable vector in accordance with Newton Raphson method using the Jacobian matrix.

4. The method for calculating plate thickness schedule for the tandem rolling mill according to claim 1, wherein the matrix includes a first component group and a second component group, wherein the second component group is configured of the derived function of the evaluation function for evaluating the error based on the first value, wherein the first component group is configured of a derived function of another evaluation function which is set to satisfy a mass flow constant law, and wherein the second component group is replaced with one of the first derived function and the second derived function in accordance with presence or absence of the parameter restriction while the first component group is constant regardless of presence or absence of the parameter restriction.

5. The method for calculating plate thickness schedule for the tandem rolling mill according to claim 1, further comprising acquiring an unknown variable vector including each unknown variable which is each delivery side plate thickness in each rolling stand, acquiring an evaluation function based on the unknown variable vector by selecting upon not occurrence of the parameter restriction a model-based evaluation function defined to satisfy a ratio of the first value, and by selecting upon occurrence of the parameter restriction a modified evaluation function defined in advance to set the second value in accordance with the parameter restriction, and calculating a selected evaluation function, determining whether or not a calculated value from the selected evaluation function is converged within a predetermined range, correcting each delivery side plate thickness of each rolling stand by updating the unknown variable vector using an inverse matrix of the matrix when the calculated value is not converged within the range, and calculating the calculated value again by calculation based on an updated evaluation function configured of the unknown variable vector updated latest.

6. A rolling plant comprising:

a plurality of rolling stands;

roll gap control devices each provided in each rolling stand of the plurality of rolling stands;

electric motors each rotating rolls in each rolling stand; and a process computer configured to calculate a plate thickness schedule of each rolling stand based a first value, the first value being one of a roll force ratio of the roll gap control device and a motor power ratio of the electric motor, wherein the process computer is configured to acquire a rolling model formula including a first value which is one of a roll force ratio and a motor power ratio in each of a plurality of rolling stands, determine whether or not a second value is restricted by parameter restriction, the second value is at least one value of roll force, motor power, and a reduction rate in each of the rolling stands, select one derived function from a first derived function and a second derived function to use the one derived function as a derived function of an evaluation function, the evaluation function evaluate an error based on the first value, the first derived function is a function configured to satisfy a ratio of the first value, the second derived function is defined in advance so that the second value is set in accordance with the parameter restriction, each derived function for each rolling stand is selected in accordance with a result of the determination so that the first derived function is selected when the parameter restriction does not occur and the second derived function is selected when the parameter restriction occurs, and modify each delivery side plate thickness in each rolling stand using a matrix including the one derived function selected from the first derived function and the second derived function in accordance with the result of the determination.

* * * * *